US007104176B2

(12) United States Patent
Lowery et al.

(10) Patent No.: US 7,104,176 B2
(45) Date of Patent: Sep. 12, 2006

(54) MINEPLOUGH

(75) Inventors: Brett Robert Lowery, Farnborough (GB); Thomas James Packard, Salisbury (GB)

(73) Assignee: Qinetiq Limited, (GB)

( * ) Notice: Subject to any disclaimer, the term of this patent is extended or adjusted under 35 U.S.C. 154(b) by 0 days.

(21) Appl. No.: 10/500,813

(22) PCT Filed: Dec. 30, 2002

(86) PCT No.: PCT/GB02/05937

§ 371 (c)(1),
(2), (4) Date: Jul. 7, 2004

(87) PCT Pub. No.: WO03/058152

PCT Pub. Date: Jul. 17, 2003

(65) Prior Publication Data

US 2005/0115388 A1 Jun. 2, 2005

(30) Foreign Application Priority Data

Jan. 9, 2002 (GB) ..... 0200369.7

(51) Int. Cl.
*F41H 11/16* (2006.01)

(52) U.S. Cl. ..... 89/1.13

(58) Field of Classification Search ..... 89/1.13; 172/699, 700

See application file for complete search history.

(56) References Cited

U.S. PATENT DOCUMENTS 3,085,635 A * 4/1963 Livermore ..... 172/699
3,561,539 A * 2/1971 Evans ..... 172/40
3,869,012 A * 3/1975 Schubach ..... 180/11
5,082,307 A * 1/1992 Hollingworth, Jr. ..... 280/13

* cited by examiner

*Primary Examiner*—Stephen M. Johnson
(74) *Attorney, Agent, or Firm*—McDonnell, Boehnen Hulbert & Berghoff LLP

(57) ABSTRACT

A mineplough which is designed to be resilient to exploding mines comprises one or more blades set at an angle to the general direction of movement of the plough so as to deflect lifted earth to one or both sides of the plough and having tines arranged so as to lift earth ahead of the blade in the direction of travel thereof, depth control means for controlling the depth of cut of the tines and at least two linkages to connect the blade to a suitable carrier vehicle for the mineplough. The blade is comprised of a number of intersecting strong metal plates whose planes lie substantially parallel to the direction of travel of the mineplough and which define relatively narrow open channels therebetween so as to allow venting of any explosion caused by a mine exploding in contact with the blade. The blade may be faced with a relatively thin metal or plastics sheet to absorb some of the force of any explosion and further protection is provided by the fact that each linkage contains at least one crushable element capable of absorbing blast energy.

9 Claims, 3 Drawing Sheets

MINEPLOUGH

BACKGROUND OF THE INVENTION

1. Field of the Invention

The present invention relates to a novel form of blade for a mineplough.

2. Discussion of Prior Art

A mineplough may be defined as the apparatus fitted to a (preferably robust) vehicle so as to create a system for effecting clearance of a path through a minefield. In particular this mode of mine clearance is appropriate for use in a wartime situation where a rapid clearance of anti-tank mines is operationally vital because it is recognised that, in these circumstances, some damage is likely to be sustained by at least the mineplough part of the system.

The main mechanical components of a mineplough are:

i) a blade which comprises:
   a) tines which are teeth mounted on the blade and which cut into the ground so as to lift the earth and any buried mines; and
   b) the mouldboard which is the part of the blade that pushes the lifted earth and mines to the side of the vehicle path to clear a lane for following traffic;

ii) a linkage system which is the mechanism connecting the plough to the carrier vehicle; and iii) a depth control system, the function of which is to try and ensure that the tines maintain a constant depth of cut. It usually comprises ground following skids which react against the vertical forces produced during ploughing.

In clearing a path through a major minefield it is recognised that up to 5 mines in total may have to be cleared and if, for example, these are fitted with anti-disturbance fuzing, this may mean up to 5 mines exploding during the clearing operation. To achieve a speedy clearance it is desirable that only one mineplough be actually involved in the operation but with current designs of mineplough it is not possible to attain the level of robustness which is required to achieve this.

SUMMARY OF THE INVENTION

It is therefore a primary objective of the invention to provide a mineplough which is sufficiently robust to withstand the blast from one or more typical anti-tank mines and yet continue to operate fully effectively.

The particular areas of weakness of current designs lie in the blade itself and most particularly in the linkage between the blade and the carrier vehicle. Accordingly the present invention seeks to provide a mineplough having both a blade and a linkage system which are more resilient towards high shock loadings that can be created by a mine exploding against any part of the mineplough. The invention therefore provides a mineplough which comprises at least one blade element which is set at an angle to the general direction of movement of the plough so as to deflect lifted earth to one or both sides of the plough, tines attached to each said blade element so as to lift earth ahead of that blade element in the direction of travel thereof, depth control means for controlling the depth of cut of the tines and at least two linkages for connecting the mineplough to a suitable carrier vehicle therefor, characterised in that each blade element is comprised of a plurality of intersecting plates whose planes lie substantially parallel to the said direction of travel and which define open channels therebetween and further characterised in that the linkages each contain at least one crushable element capable of absorbing blast shock.

By providing a generally open structure to the mouldboard, the soil and other blast products which are thrown up by a mine exploding ahead of or on contact with a tine are vented through the blade to a high degree thus lowering the loading on the connecting linkage in particular. Further by providing a structure with considerable depth perpendicular to the blade face, the blade is extremely strong and this, coupled with the relatively small surface area which is presented to blast products by the edges of the intersecting plates, means that the blade structure is highly resistant to damage. Typically the depth of the blade in the direction of its travel will be of the order of 150 mm.

The blade channels defined by the intersecting plates should be relatively narrow such that in operation the channels will tend to clog up with soil and hence ploughing action will be maintained. In any event the channels should be of such dimensions as to ensure that any anti-tank mine will be unable to pass through the blade. Advantageously, however, the vented blade structure is faced on its front surface with a relatively weak covering plate which will act as a normal mouldboard during ploughing but at the same time is able to absorb some of the blast effect should a mine explode adjacent to the blade. However, the covering plate should only be of such strength that it will fail, at least locally, without causing sufficient resistance to the blast as to allow damage to be caused elsewhere in the system (and particularly to the linkage). Although even a first blast may thus cause a substantial disruption to the covering plate (mouldboard) this is likely only to be within an area adjacent to the seat of the explosion and the protective effect of the plate is unlikely to be totally lost even after a number of mines have exploded. Apart from that, as mentioned earlier, even where some of the blade channels through the blade structure have become exposed through degradation of the covering plate, it is likely that, in operation, they will block up with soil and thus a degree of blast resistance will remain even with those channels (as well of course for those areas of the blade which remain protected by undamaged portions of the covering plate).

Advantageously, the structure of the blade comprises a plurality of plates disposed in a substantially vertical arrangement and a further set of plates intersecting these and arranged in a substantially horizontal manner. The spacing of the plates in both dimensions should be such as to ensure that no mine which is likely to be encountered will pass through any of the channels defined by the sets of plates and also such as to ensure that the blade has a sufficient overall strength, while being at the same time sufficiently far apart that the blast venting effect of the blade structure of the invention is maintained. When the plates are arranged in this manner a further advantage of the blade structure of this invention can be achieved by arranging that the tines are formed by an extension of the vertical plates of the blade structure and are thus integral with the rest of the blade. This gives the tines additional strength and resistance to disruption.

Preferably the tines are further strengthened by providing them with bracing pieces which are attached between pairs of adjacent tines. Such bracing members should be relatively thin in the direction of travel of the blade so as to present little or no interference to the blade ploughing action. For the same reason, it is also preferred that the bracing members be set back from the front edges of the tines to which they are attached.

The two sets of intersecting plates described above may conveniently each have co-operating slots provided in them so that, to assemble a blade element, the respective plates are simply slid together to interlock. The plates are then welded together along the length of each intersection using a large section fillet weld (typically 20 mm).

The mineplough may comprise either a single angled blade element or may comprise two blade elements forming a V-shaped blade overall, depending on the size of clearance path required, the nature and effective power of the carrying vehicle used, the nature of the terrain etc.

The linkage of the mineplough of this invention has a crushable element which acts to absorb some of the forces which would otherwise be transmitted from the blade through the linkage to the carrier vehicle and which could otherwise cause the linkage to fail. In particular the pins (termed the "boom arm pins") which allow for motion of the blade at an angle to the direction of travel are likely to suffer from high levels of stress if the blade is subject to a mine exploding at close range and this could cause the pins to fail in shear.

The crushable element suitably comprises a series of substantially U-shaped channel members located ahead of the boom arm pins in the direction of travel of the blade (i.e. between the blade and the boom arm pins which the members are intended to protect). The channel members are designed to crush under a loading which is below the shear strength of the boom arm pins. For additional resilience and to achieve better lateral stability of the blade, two sets of channel members could be provided, one of which sets is positioned vertically and the other set of channel members positioned horizontally with respect to the blade. In an alternative arrangement, the channel members could be replaced with a series of short tubes designed to crumple under a shock load and so to act as energy absorbers and it will be readily apparent to the skilled addressee that other means of providing the desired resilience in the linkage system can be contemplated and are to be understood as falling within the scope of the invention.

BRIEF DESCRIPTION OF THE DRAWINGS

The invention will now be further described with reference to the accompanying drawings in which.

DETAILED DESCRIPTION OF TILE PREFERRED EMBODIMENTS

Figure 1:
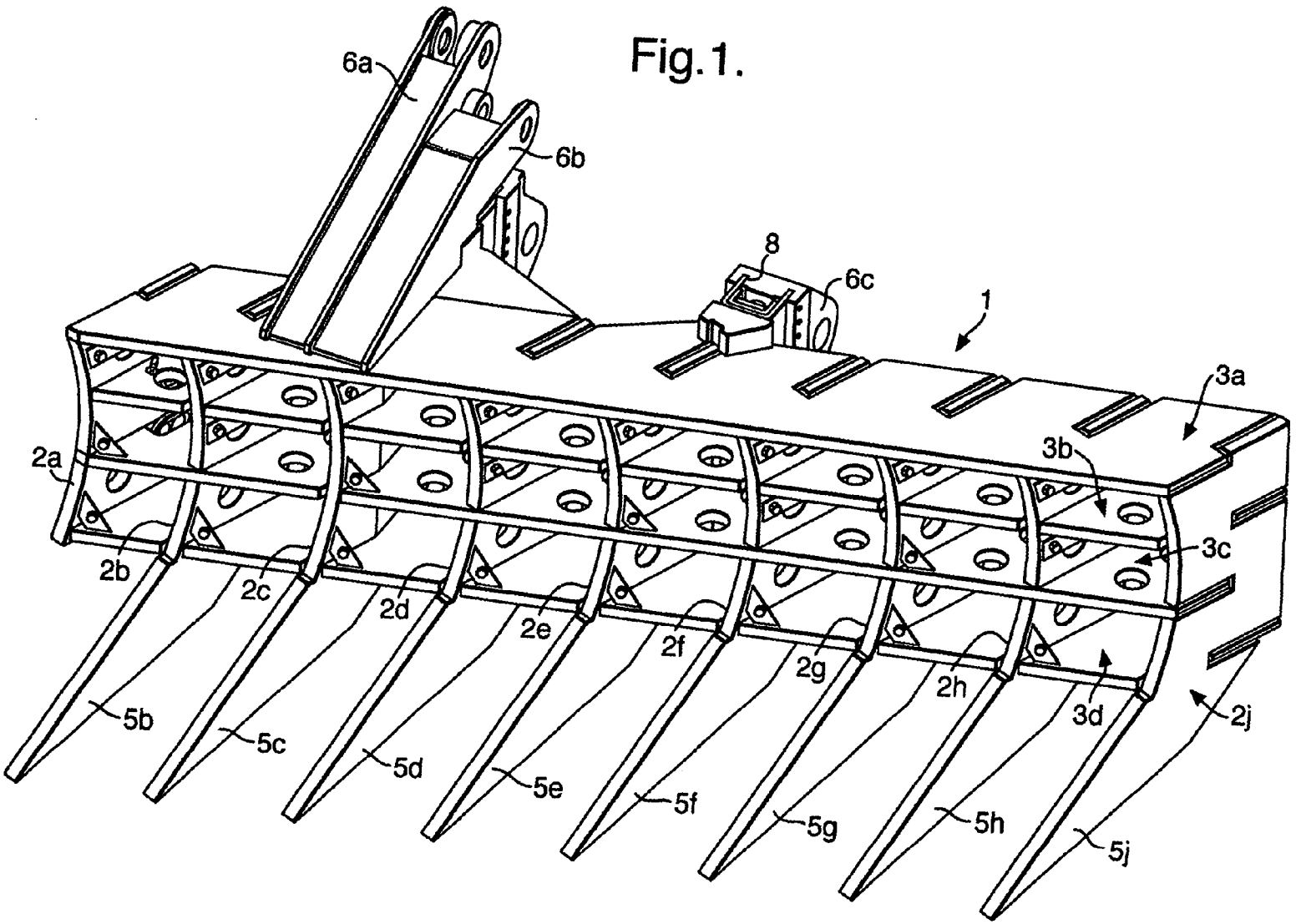
FIG. 1 is a three dimensional view of a single angled mineplough blade according to the invention.

In FIG. 1 there is shown a mineplough 1 which comprises a set of 9 vertical plates (2*a* to 2*j*) and a further set of four horizontally-disposed plates (3*a*–3*d*) constituting the mouldboard. It can be seen that all but one of the vertical plates are extended downwards and forwards of the blade to form a series of tines, 5*b*–5*j*. The plates are conveniently made from steel, for example, Rolled Quenched Tempered (RQT) 701 (a product of Corus Ltd) or a Rolled Homogeneous Armour material. In the case of RQT701 a suitable thickness will be of the order of 20 mm for the horizontal plates and 25 mm for the vertical plates. Three connecting members 6*a*, 6*b*, 6*c* are attached generally at the rear of the blade for connecting it to the linkage (not shown). (It will be noted that the horizontal plates to which these connecting members are attached are extended outwards towards the connecting members in order to strengthen the plates in the area where the two are connected). A U-shaped channel member 8 is shown generally associated with the connecting member 6*c*.

Figure 2:
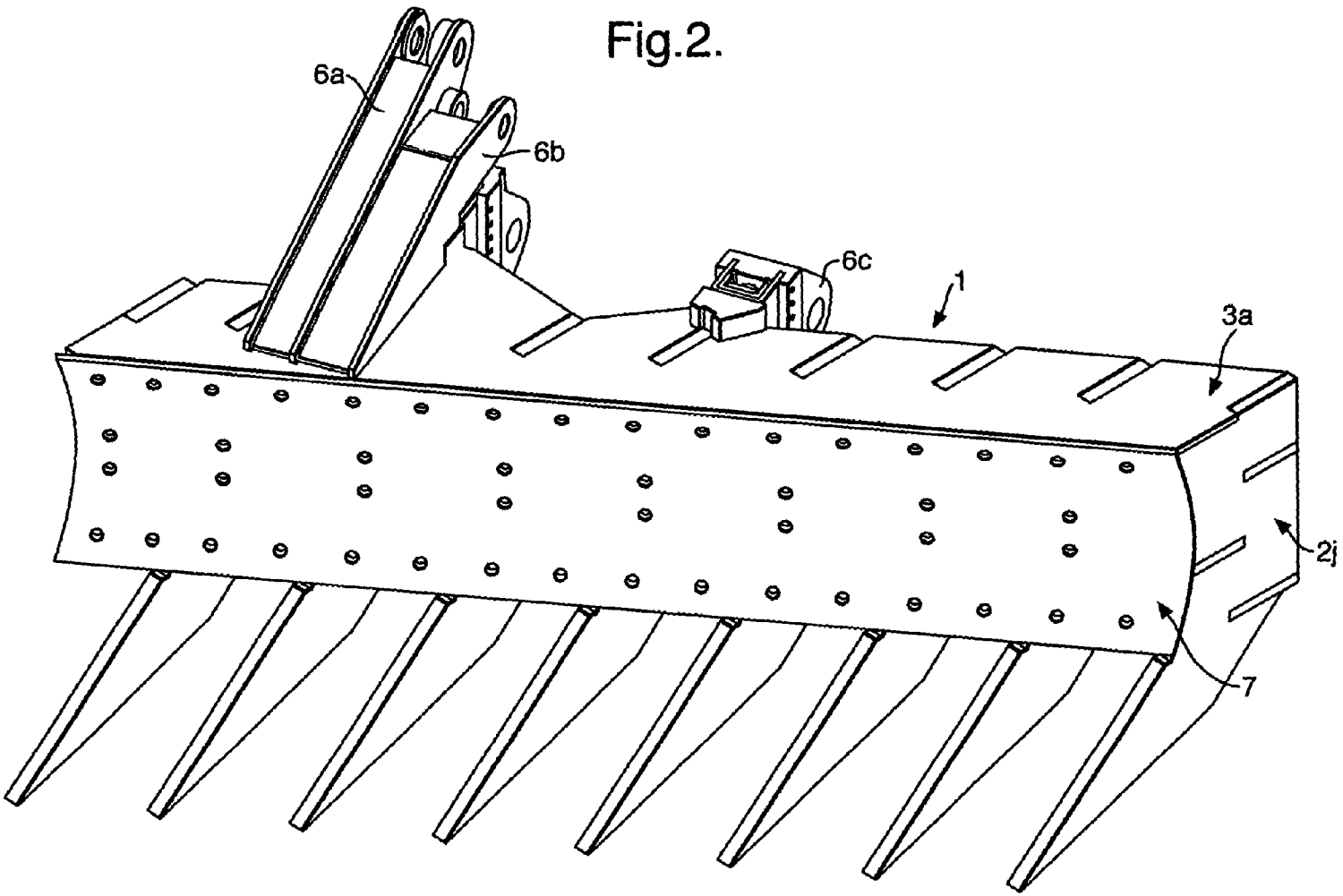
FIG. 2 is a similar view of the same blade as shown in FIG. 1, but having a covering plate (mouldboard) attached.

In FIG. 2 there is shown the same blade as in FIG. 1 except that the front face of the blade is now covered with a thin facing plate 7. This plate may be made from steel of 4 mm thickness or may comprise a plate of 5 or 10 nm thickness of high density polyethylene but it will be readily appreciated that the materials to be used will be dependent to some degree on the size of the openings in the blade structure and on the strength of the linkages among other factors.

Figure 3:
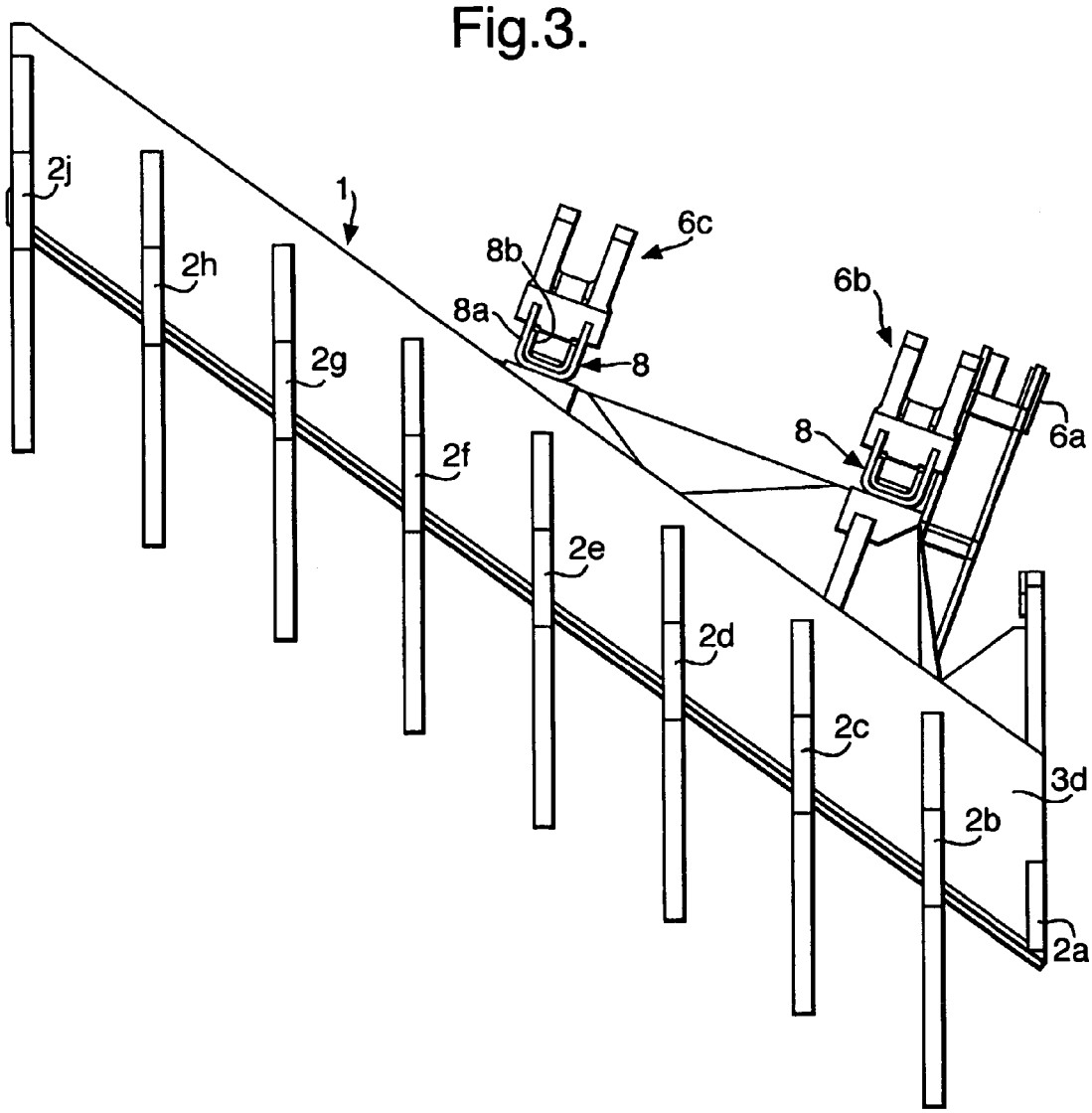
FIG. 3 is a plan view of the same blade as shown in FIG. 1 looking from the underside of the blade and showing in more detail a part of the linkage to the carrier vehicle.

FIG. 3 shows in greater detail the linkage arrangements of the blade shown in FIGS. 1 and 2 and the same parts are identified by use of the same numerals as for those Figures. In this drawing the lower ends of vertically-disposed U-shaped channel members 8 associated with both of the connecting members 6*b* and 6*c* are shown. Each channel member comprises two channel pieces, 8*a* and 8*b*, of which one is housed within the other and provides support once the outer pieces have distorted under a shock load. In this way the channel members can successfully absorb the blast energy from two mines exploding against the blade and protect the linkages from damage.

The invention claimed is:

1. A mineplough which comprises at least one blade element which is set at an angle to the general direction of movement of the plough so as to deflect lifted earth to one or both sides of the plough, each said blade element having tines arranged so as to lift earth ahead of that blade element in the direction of travel thereof, and at least two connecting members wherein each blade element is comprised of a number of intersecting plates whose planes lie substantially parallel to the said direction of travel and which define open channels therebetween and further wherein each of the connecting members contains at least one crushable element capable of absorbing blast energy.

2. A mineplough as claimed in claim 1 wherein the intersecting plates comprise a first set of plates arranged substantially in a vertical plane and a second set of plates arranged substantially at right angles to the first set.

3. A mineplough as claimed in claim 2 wherein the vertically-disposed plates are extended generally downwards and forwards of the blade to form the tines.

4. A mineplough as claimed in claim 1 wherein the open channels between the plates are of smaller dimension than any mine which the plough is intended to clear.

5. A mineplough as claimed in claim 1 wherein the open channels have a minimum dimension of the order of 150 mm.

6. A mineplough as claimed in claim 1 wherein the front face of the blade is covered with a covering material capable of being disrupted by a blast of energy.

7. A mineplough as claimed in claim 6 wherein the covering material is comprised of a thin sheet of metal or a plastics material.

8. A mineplough as claimed in claim 1 wherein the at least one crushable element comprises a substantially U-shaped channel member arranged so as to absorb blast energy by at least partially collapsing.

9. A mineplough as claimed in claim 8 wherein the channel member comprises first and second U-shaped channel pieces arranged such that the first U-shaped channel piece lies within the second U-shaped channel piece and the first U-shaped channel piece becomes effective to absorb blast energy only once the second U-shaped channel piece has been deformed.

* * * * *